US006642526B2

(12) United States Patent
Hartley

(10) Patent No.: US 6,642,526 B2
(45) Date of Patent: Nov. 4, 2003

(54) FIELD IONIZING ELEMENTS AND APPLICATIONS THEREOF

(75) Inventor: Frank T. Hartley, Arcadia, CA (US)

(73) Assignee: Ionfinity LLC, Altadena, CA (US)

( * ) Notice: Subject to any disclaimer, the term of this patent is extended or adjusted under 35 U.S.C. 154(b) by 0 days.

(21) Appl. No.: 10/180,813

(22) Filed: Jun. 25, 2002

(65) Prior Publication Data

US 2003/0038245 A1 Feb. 27, 2003

Related U.S. Application Data

(60) Provisional application No. 60/301,092, filed on Jun. 25, 2001, provisional application No. 60/336,841, filed on Oct. 31, 2001, and provisional application No. 60/347,685, filed on Jan. 8, 2002.

(51) Int. Cl.[7] ..... H01J 27/02

(52) U.S. Cl. ..... 250/423 F; 250/423 R; 313/230

(58) Field of Search ..... 250/423 F, 423 R; 313/230

(56) References Cited

U.S. PATENT DOCUMENTS

| | | | | |
|---|---|---|---|---|
| 3,147,445 | A | | 9/1964 | Wuerker |
| 3,947,716 | A | | 3/1976 | Fraser |
| 3,970,887 | A | | 7/1976 | Smith |
| 4,027,165 | A | | 5/1977 | Jacobs |
| 4,307,507 | A | | 12/1981 | Gray |
| 4,311,669 | A | | 1/1982 | Spangler |
| 4,685,996 | A | | 8/1987 | Busta |
| 4,855,636 | A | | 8/1989 | Busta |
| 4,857,799 | A | | 8/1989 | Spindt |
| 4,926,056 | A | * | 5/1990 | Spindt ..... 250/423 F |
| 4,964,946 | A | | 10/1990 | Gray et al. |
| 5,053,343 | A | | 10/1991 | vora |
| 5,192,865 | A | | 3/1993 | Zhu |
| 5,493,115 | A | | 2/1996 | Deinzer |
| 5,614,072 | A | | 3/1997 | Vigh |
| 5,668,373 | A | | 9/1997 | Robbat |
| 5,672,868 | A | | 9/1997 | Mordehai. |
| 5,726,076 | A | | 3/1998 | Tasker |
| 5,726,448 | A | | 3/1998 | Smith |
| 5,736,739 | A | | 4/1998 | Uber |
| 5,738,774 | A | | 4/1998 | Harrison |
| 5,879,949 | A | | 3/1999 | Cole |
| 5,909,086 | A | | 6/1999 | Kim |
| 5,952,652 | A | | 9/1999 | Taylor |
| 5,962,288 | A | | 10/1999 | Aksenov |
| 6,051,378 | A | | 4/2000 | Monforte |
| 6,060,327 | A | | 5/2000 | Keen |
| 6,100,521 | A | | 8/2000 | Doring |
| 6,159,686 | A | | 12/2000 | Kardos |
| 6,289,242 | B1 | | 9/2001 | Phipps |
| 6,323,482 | B1 | | 11/2001 | Clemmer |

* cited by examiner

*Primary Examiner*—Jack Berman
(74) *Attorney, Agent, or Firm*—Carl A. Kukkonen, III

(57) ABSTRACT

A field ionizing element formed of a membrane that houses electrodes therein that are located closer to one another than the mean free path of the gas being ionized. The membrane includes a supporting portion, and a non supporting portion where the ions are formed. The membrane may be used as the front end for a number of different applications including a mass spectrometer, a thruster, an ion mobility element, or an electrochemical device such as a fuel cell.

57 Claims, 4 Drawing Sheets

FIELD IONIZING ELEMENTS AND APPLICATIONS THEREOF

CROSS-REFERENCE TO RELATED APPLICATIONS

This application claims benefit of U.S. Provisional Application No. 60/301,092, filed Jun. 25, 2001, U.S. Provisional Application No. 60/336,841 filed on Oct. 31, 2001, and U.S. Provisional Application No. 60/347,685 filed on Jan. 8, 2002, all of which are hereby fully incorporated by reference.

This invention was made in part with Government support under contract NASA-1407 awarded by NASA. The Government has certain rights in this invention.

BACKGROUND

Many different applications are possible for ionization systems. For example, it is desirable to form a pumpless, low mass sampling system for a mass spectrometer.

Conventional mass spectrometers often use "hard" techniques of producing ion fragments, in which certain parts of the molecule are forcibly removed, to form the fragmented ion. For example, the fragments may be produced by ultraviolet, radioactive, and/or thermal electron ionization techniques. Some of these techniques, and specifically the thermal technique, may require a vacuum to enhance the life of the filament source.

Different systems which use ionization are known. A quadrupole and magnetic sector/time of flight system ionizes a sample to determine its content. These devices have limitations in both operation and size. Many devices of this type may operate over only a relatively small mass sampling range. These devices may also suffer from efficiency issues, that is the ions might not be efficiently formed.

Many of these systems also require a very high vacuum to avoid ion collisions during passage through the instrument. For example, the systems may require a vacuum of the level of such as $10^{-6}$ Torr. A vacuum pump must be provided to maintain this vacuum. The vacuum pump consumes power, may be heavy, and also requires a relatively leak free environment. This clashes with the usual desire to miniaturize the size of such a device.

Other applications could he desirable for ionization, if an ionization system were sufficiently small. However, the existing ionization systems have problems and difficulties in fabrication which has prevented them from being used in certain applications.

SUMMARY

The present application describes a special ionization membrane, along with applications of this special ionization membrane that are facilitated by the membrane.

A first application uses the ionization membrane as part of a mass spectrometer.

Another application uses the ionization membrane for other applications. According to an aspect of this invention, the electrodes are formed closer than the mean free path of a specified gas, for example the gas being considered. This may ionize gas molecules in free space. Different applications of this soft ionization technique are described including using this system in a mass spectrometer system, such as a rotating field mass spectrometer. This may also be used in a time of flight system.

In an embodiment, a pumpless mass spectrometer is described which does not include a pump for either forming the vacuum or for driving the ions.

Another embodiment describes using this system for an electrochemical system. Another application describes using this system in propulsion.

BRIEF DESCRIPTION OF THE DRAWINGS

These and other aspects will now be described in detail with reference to the accompanying drawings, wherein.

DETAILED DESCRIPTION

Gas may be ionized in a high electric field. Avalanche arcing may be produced by the gas ionization. It has been found by the present inventor, however, that when the "mean free path" between molecules is greater than electrode separation, only ionization occurs.

Figure 1:
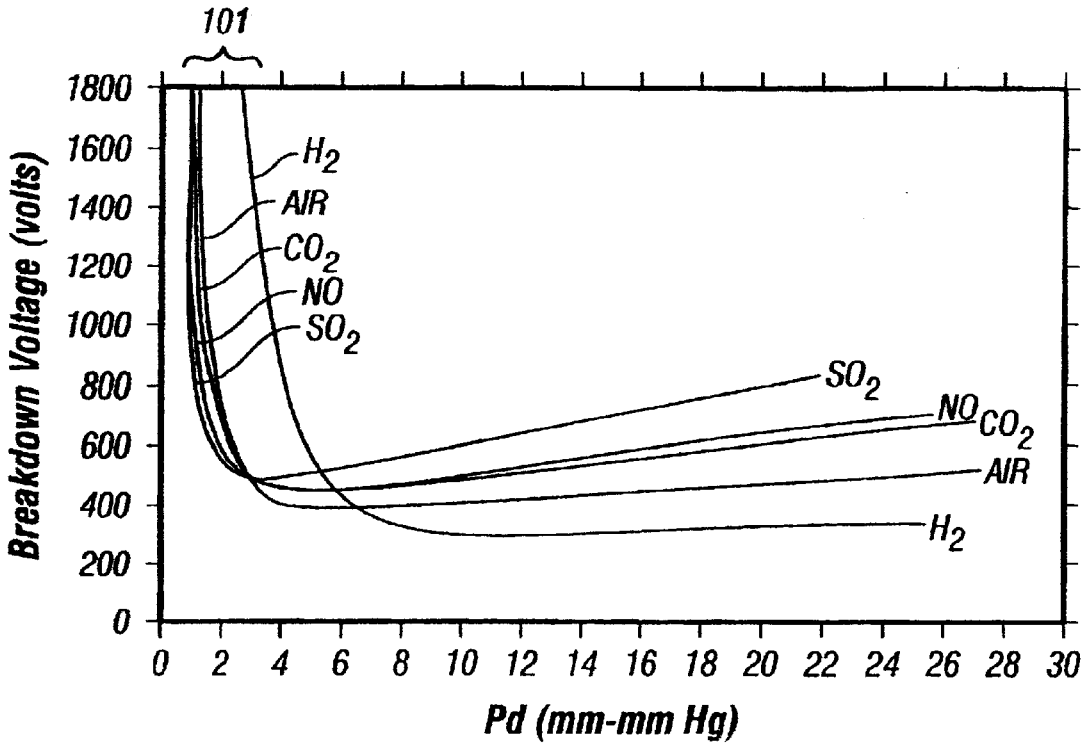
FIG. 1 shows Paschen curves for various gases.

FIG. 1 shows the Paschen curves for various gases. This represents the breakdown voltage of the gas at various characteristic points. On the left side and under each Paschen curve, ionization of the gas occurs using the special membrane described herein. This technique is "soft" in the sense that it ionizes without fragmenting the molecular structure of the gas being ionized. That means that large organic compounds can be analyzed without breaking them into smaller atomic fragments.

Figure 2A:
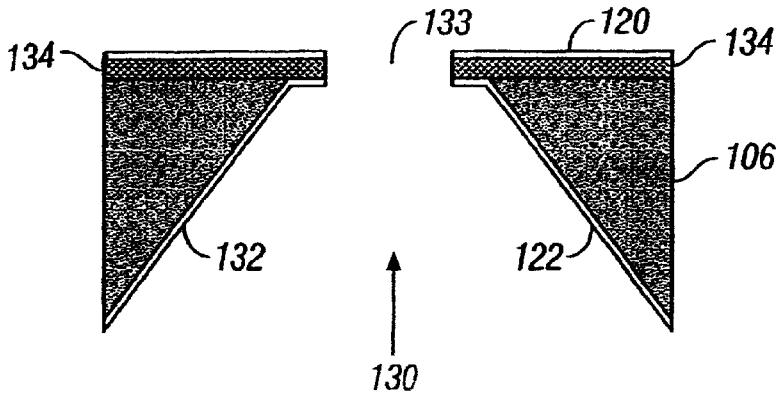
FIGS. 2*a*–2*c* show details of the special ionization membrane of the present system, with FIG. 2*b* showing a cross-section along the line 2*b*—2*b* in FIG. 2*c* and FIG. 2*a* showing a close-up detail of one of the holes in FIG. 2*b;*
Figure 2B:
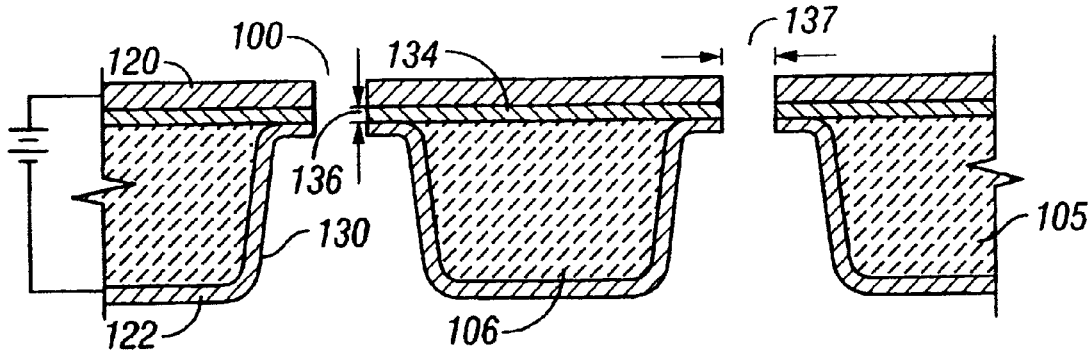
Figure 2C:
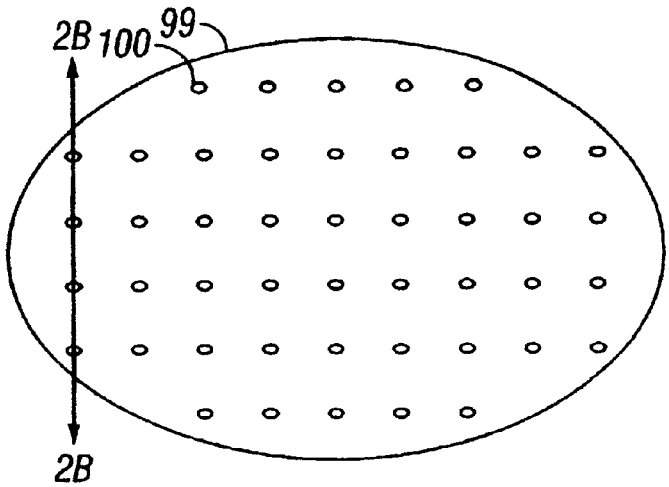

Details of the membrane are shown in FIGS. 2A–2C, with FIGS. 2A & 2B showing cross sections of the membrane of FIG. 2C. The miniature ionization device 99 is formed by micromachining an array of small holes 100 through a relatively thin membrane 105. The membrane 105 may be, for example, of sub micron thickness. The material 106 of the substrate itself may be silicon or any other easy-to-machine material. Metal electrodes 120,122 are located on respective sides of the membrane 100. The metal can be any material such as chrome or titanium or gold.

In formation of the membrane 99, a plurality of holes such as 130 are formed from the bottom 132. The holes may generally taper as shown towards the top portion 133 of the hole. The top portion 133 of the hole 130 may have a dimension 137 which may be, for example, 2 to 3 microns. Openings may be formed in the top metal coating 120, and in the bottom metal coating 122. For example, the hole may be formed by focused ion-beam milling (maskless process).

The substrate material 106 also includes a dielectric layer 134 which can be for example, silicon nitride, alumina, or any other similar material that has a similar dielectric breakdown. The thickness 136 of the dielectric layer sets the distance between the metal electrodes 120 and 122. The dielectric thickness can be to 200–300 nm The dielectric can in fact be thinner than 200 nm, in fact can be any thickness, with thicknesses of 50 nm being possible.

In a preferred system, the distance between the electrodes 120, 122 is less than 1 micron. When this small separation is maintained, electric field strengths on the range of mega volts per meter are produced for each volt of potential difference between the electrodes 120, 122.

The inventor has noted that the membranes could not be formed simply from the thin, sub micron elements. Membranes that are formed in this way could be too fragile to sustain a pressure difference across the membrane, or to survive a minor mechanical shock. In this embodiment, the thicker supporting substrate part 105 is used, and is back-etched through to the membrane. By forming the substrate in this way, that is with a relatively thick substrate portions such as 105/106, separated by back etched holes such as 100, the structure of the device can be maintained while keeping a relatively small distance between the electrodes.

An embodiment is described herein which uses the field ionizer array, which may be a micromachined field ionizer membrane, with a lateral accelerator, which is coupled to a mass spectrometer.

An array of cathode electrodes may be deployed. The cathode electrodes may be derived from active pixel sensor array of the type described in U.S. Pat. No. 5,471,215, and as conventional may include various types of on-chip matrix processing. This system may use an electrode sensor of 1024 by1024 pixels, with sub pixel centroiding and radial integration. The active pixel sensor itself may have a sensitivity on the order of $10^{-17}$ amps. By adding pixel current processing, another two orders of magnitude of sensitivity may be obtained.

Forming the mass spectrometer in this way enables the device to be formed smaller, lighter, and with less cost than other devices of this type. This enables a whole range of applications; such as in situ biomedical sampling. One application is use of the miniature mass spectrometer is for a breathalyzer. Since there are no electron beam filaments and the like, any of the system components can operate at relatively higher pressures, for example 5 to 7 Torr pressures or higher. With a Faraday cup electrometer ion detector, sub femtoamp levels of sensitivity may be obtained. This system could be used as a portable device for finding various characteristics in exhaled breath. For example, detection of carbon monoxide in exhaled breath may be used as a screening diagnostic for diabetes.

Figure 3:
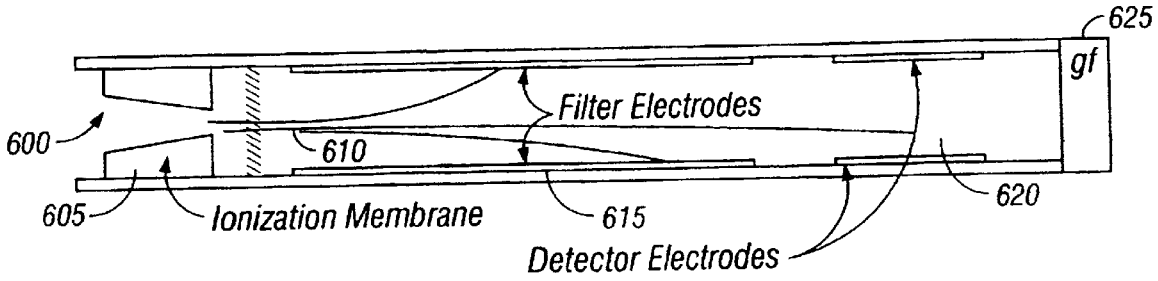
FIG. 3 shows an ion mobility spectrometer.

Another application of this system is for use in a miniature ion mobility spectrometer as shown in FIG. 3. Conventional ion mobility spectrometers use a shutter gate. This provides short pulses of ions. The shortened pulses of ions are often limited to about 1 percent of the total number of ions that are available for detection. However, resolution of such a device is related to the width of the ion purse. The width of the ion pulse cannot be increased without correspondingly decreasing the resolution.

In the improved system of FIG. 3, total and continuous ionization of sample gas and continuous introduction of all ions into the chamber is enabled. Sample gases are introduced as 600 into the ionization membrane 605 of the type described above. In general, the ionization membrane 605 could include either a single pore device or could have multiple pores within the device.

Ions 610 from the membrane exit the membrane as an ion stream. Electrons in contrast move back behind (that is, to the other side of) the membrane, and may further contribute to the ionization of the incoming gases. The atoms or molecules are carried through the body of the spectrometer by a gas feed system 625. The gas feed system includes either an upstream carrier gas supply and Venturi sampler, or a downstream peristaltic pump.

The ions are drawn towards the filter electrode 615 which receive alternating and/or swept DC electric fields, for the transverse dispersal of the ions. A repetitive ramping of the DC fields sweeps through the spectrum of ion species.

An important feature of this device is the high field strengths which can be obtained. At moderate field strengths, for example <100,000 volts per meter, the mobility of ions at atmospheric and moderate pressures is constant. However, at higher field strengths, such as 2 million volts per meter or greater, the mobility of the ions is nonlinear. The mobility changes differentially for high and low mobility ions. This change, may be, for example, by 20 percent. Therefore, by applying a waveform that is formed of a short high-voltage and a long low or negative voltage to the filter electrodes, the ion species is disbursed between the filter electrodes. This waveform may be selected to provide a zero time averaged field. In operation, the ions are transported laterally by a carrier gas stream. A low strength DC field may be supplied in opposition to the other field. This fields applied to the filter electrode may straighten the trajectory of specific ion species, allowing their passage through the filter. The other ion species collide with the electrodes. Sweeping of the DC field may facilitate detection of the complete ion spectrum.

Detector electrodes 620 are located downstream of the filter electrodes 615. The selected ions have straightened trajectories, and these detector electrodes 620 deflect the straightened-trajectory ions into detection electrodes, where they are detected. The detected current provides a direct measure of the number of ions. The number of ions is effectively proportional to the vapor concentration.

It should be understood that this gas feed system could be either upstream or downstream in this way.

Another embodiment uses this ionization technique to form a free space ion thruster.

Figure 4:
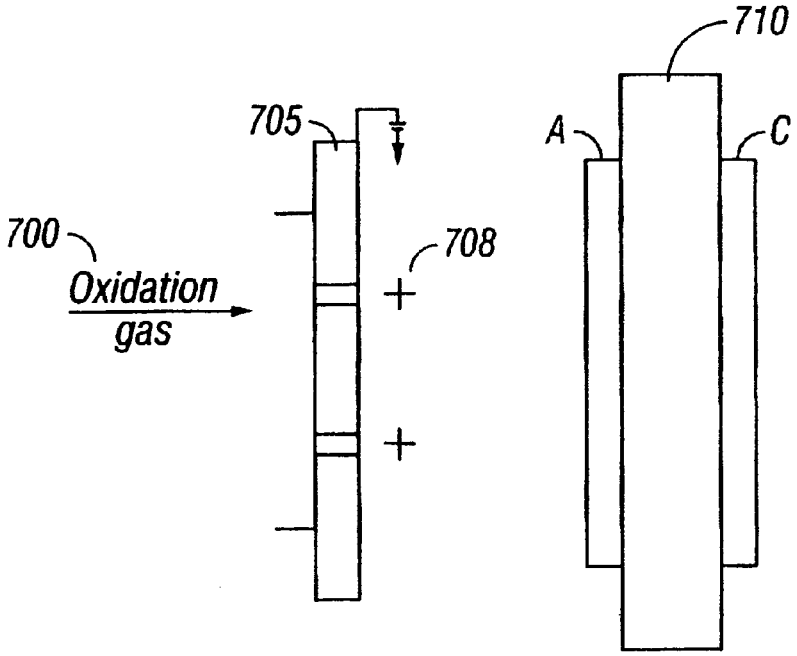
FIG. 4 shows a solid-state ionization membrane being used in an electrochemical device.

Yet another embodiment describes use of an ionizer of this type in a fuel cell. Previous fuel cell proton exchange membranes have used platinum or other electrooxidation catalysts to facilitate proton transfer. In this system, the oxidation gas or gases 700 is passed through the pores of a membrane 705 under an extreme electric field as shown in FIG. 4. The oxidation gas or gases 700 are completely ionized on passage through the membrane. The gas 708 once ionized, now has a positively charged aspect. The gas 708 drifts to the membrane 710 where the electrooxidized state of the gas enhances its transfer through the cathode. The transfer of atomic species through the membrane in this way reduces the partial pressure between the ionizer 705 and the membrane 710, this causing further inflow through the ionizer pores of the oxidation gas 702. The ionizer potential may alternatively be maintained positive with respect to the cathode membrane in order to accelerate the ions to an increased velocity before imprinting on the cathode membrane which forms the accelerator grid.

Figure 5:
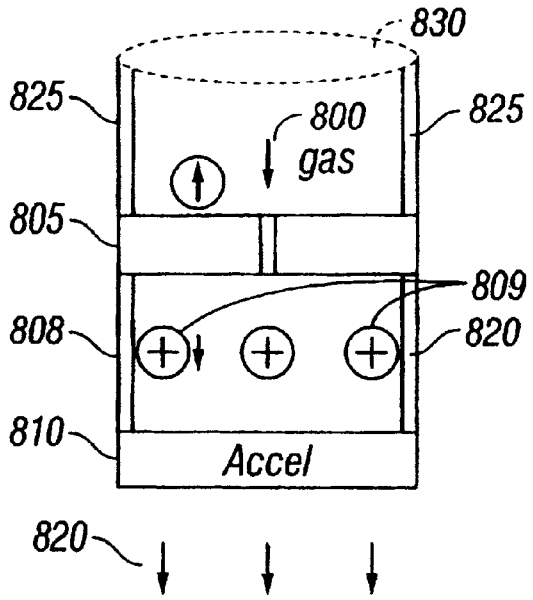
FIG. 5 shows the ionization membrane being used as a propulsion system.

Another embodiment, shown in FIG. 5, uses this ionization membrane as part of a miniature ion thruster. This may form a thrust system using propellant gas. Propellant gas 800 is ionized by passing it through the pores of a membrane 805 of the type described above, under a high electric field. This forms positively charged ions 809 from the gas. The ions 810 enter another field 808 between the membrane and a porous accelerator grid 810. This other field 808 accelerates the ions to an increased velocity, and expels them from the thruster as 820.

The electrons are caused to move back behind the membrane where a small electric field and magnetic field may linearly and rotationally accelerate the electron beam around to eject the electrons from the thruster with the same vector but reduced velocity as the ion beam. Since the ion and electron currents are substantially identical, this system becomes effectively charge neutral.

This system may use a small tube 820 of 1.5 cm long; 2 nm in diameter, of dielectric materials such as quartz. The tube 820 may be eutectically bonded to the top of the membrane 805. The micromachined conductive grid is similarly affixed to the top of the tube. The bottom of the membrane may also be eutecticly bonded to a thruster housing 825. That housing may contain another accelerating grid 830 and magnets.

Figure 6:
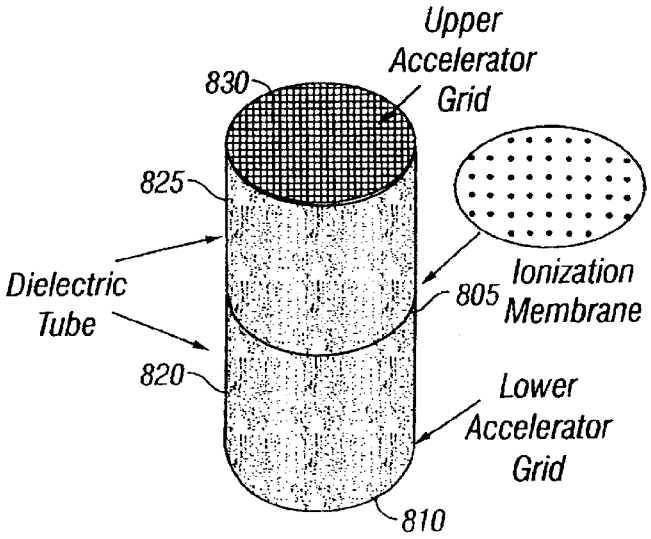
FIG. 6 shows this propulsion system in its housing with top and bottom accelerator grids.

An exterior view of the structure is shown in FIG. 6, which shows the tube for any particular accelerator grid potential, the thrust of the engine is determined by the gas flow through the membrane pores. This system may use a plurality of miniature ionization tubes such as the one described above, that are disbursed across the surface of the structure. These tubes may be deployed individually or collectively by connecting them into a circuit. The ions from each of these tubes arc accelerated under the influence of a localized electric field that is along the vector representing the least distance to the peripheral grid. The aggregate thrust is the geometrically integrated mass-momentum of all connected free space ion thrusters.

In this embodiment, a bipolar ion thruster may allow reversing the electrode potentials on the ionization membrane, causing the electrons to pass through the membrane, while ions move behind the membrane. The high velocity ions are expelled from the front of the thruster, and electrons are expelled from the rear of the thruster. This engine can therefore be reversed in this way.

Figure 7:
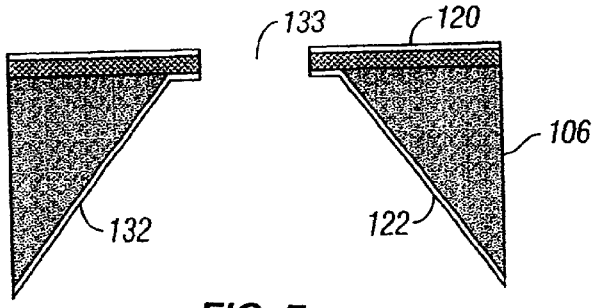
FIG. 7 shows an aperture to carry the gas into the ionization field.

When used in a vacuum, a low-pressure gas may need to be introduced into the membrane aperture that has a velocity sufficient to carry the gas into the ionization field. FIG. 7 shows an illustration of the way gas expands in a vacuum and has its molecules accelerated to supersonic speed while cooling, and directed through the membrane. Once ionized, the accelerating ions will create a partial vacuum behind them, which partial vacuum encourages further gas flow through the membrane. Gas that remains behind the membrane is ionized, and its negative field directs those ions through the membrane.

This system may have many different applications including biomedical applications such as a breath analyzer, as well as applications in other systems. It may have applications environment monitoring, personal monitoring, reviewing of water quality, automobile MAP control, detection of explosives, chemical and biological agent detection, and in an artificial nose type product.

What is claimed is:

1. A system, comprising:

an ionizing device, comprising a substrate having at least one opening, a first conductive electrode extending on a first surface of the substrate and a second conductive electrode extending on a second surface of the substrate, and a separator insulating element, having a thickness less than 1 micron, separating said first and second conductive electrodes at said at least one opening, said first and second conductive electrodes being separated by a width of said separator insulating element.

2. A system as in claim 1, wherein said first and second conductive electrodes are separated by less than 300 nm at said at least one opening.

3. A system as in claim 1, wherein said separator insulating element is a dielectric.

4. A system as in claim 3, wherein said separator insulating clement is formed of silicon nitride or alumina.

5. A system as in claim 1, wherein said first and second electrodes are formed of one of gold, chrome or titanium.

6. A system as in claim 1, further comprising an element which receives ions from said ionizing device.

7. A system as in claim 1, wherein there are a plurality of thin portions, and said thin portions are each formed from first and second conductive electrodes which arc separated by said less than 1 micron.

8. A system as in claim 1, wherein said first and second conductive electrodes are separated by less than a mean free path of a gas being analyzed.

9. A system as in claim 1, wherein said first and second conductive electrodes are separated by less than 200 nm at said at least one opening.

10. A system as in claim 1 wherein said first and second conductive electrodes are separated by approximately 50 nm at said at least one opening.

11. A system as in claim 1 wherein said at least one opening tapers inwardly from the first surface of the substrate to the second surface of the substrate.

12. A system as in claim 1 wherein said at least one opening has a diameter approximately in the range of 2–3 microns.

13. An ionizing membrane, comprising:

a thick supporting portion with at least one opening formed in the thick supporting portion;

an insulating clement coated on a surface of the thick supporting portion configured to form a hole within each at least one opening in the thick supporting portion; and first and second metal electrodes coated on surfaces of the thick supporting portion extending into the openings in the thick supporting portion, where the insulating element separates the first and second metal electrodes within the holes of the insulating element by a distance less than the mean free path of a material being ionized.

14. A system as in claim 13, wherein said insulating element separates said first and second conductive electrodes by less than 1 micron in the holes.

15. A system as in claim 13, wherein said insulating element separates said first and second conductive electrodes by less than 300 nm in the holes.

16. A system as in claim 13, wherein said insulating element separates said first and second conductive electrodes by less than 200 nm in the holes.

17. A system as in claim 13, wherein said insulating element separates said first and second conductive electrodes by less than 50 nm in the holes.

18. A method as in claim 13, wherein said insulating clement comprises a dielectric.

19. A system as in claim 13, wherein said insulator element is formed of silicon or alumina.

20. A system as in claim 13, wherein said first and second electrodes are formed of one of gold, chrome or titanium.

21. A system as in claim 13, further comprising an element which receives ions from said ionizing device.

22. A method of forming an ionization membrane, comprising:

forming a layer of thin dielectric material on a substrate that has a first specified thickness of a sufficient thickness to maintain structural integrity;

forming a first electrode on the first surface of said thin dielectric material, said first electrode being formed of a metal material;

back etching at least one hole in said substrate;

forming a second electrode on a second surface of the substrate including the at least one back etching holes, such that at least a portion of the second electrode is on a second surface of the thin dielectric material; and forming holes in the second electrode, thin dielectric material and the first electrode, which holes have side surfaces where the first and second electrodes are separated by a width of the thin dielectric material.

23. A method as in claim 22, wherein said thin dielectric material has a thickness which is less than the mean free path of the gas intended to be ionized by the ionization membrane.

24. A method as in claim 22, wherein said forming electrodes comprises depositing gold, chrome, or titanium.

25. A method as in claim 22, wherein said forming a thin dielectric comprises depositing silicon nitride or alumina.

26. A method as in claim 22, wherein said thin dielectric has a thickness less than 500 nm.

27. A method as in claim 22, wherein said thin dielectric has a thickness less than 300 nm.

28. A method as in claim 26, further comprising applying a voltage less than 15 volts between said first and second electrodes to form a field between said first and second electrodes in the range of megavolts per meter.

29. A method as in claim 22, wherein said thin dielectric has a thickness of approximately 50 nm.

30. A method as in claim 22, wherein said forming holes in the second electrode comprises ion-beam milling.

31. A method as in claim 22, wherein said forming a thin dielectric comprises silicon nitride or alumina.

32. A method as in claim 22, wherein said back etching at least one hole in said substrate forms at least one hole tapered inwardly.

33. A method as in claim 22, wherein the holes formed by said forming holes in the second electrode, thin dielectric material and the first electrode are approximately 2–3 microns in diameter.

34. A method of forming a ionizing source, comprising:

forming a layer of thin dielectric material on a substrate that has a first specified thickness of a sufficient thickness to maintain structural integrity;

forming a first electrode on the first surface of said thin dielectric material, said first electrode being formed of a metal material;

forming at least one hole in said substrate;

forming a second electrode on a second surface of the substrate including the at least one hole in said substrate, such that at least a portion of the second electrode is on a second surface of the thin dielectric material; and forming at least one hole in the second electrode, thin dielectric material and the first electrode, which at least one hole has side surfaces where the first and second electrodes are separated by a width of the thin dielectric material.

35. A method as in claim 34, wherein said fanning at least one hole in said substrate comprises ion-beam milling.

36. A method as in claim 34, wherein said forming at least one hole in the second electrode, thin dielectric material and the first electrode comprises ion-beam milling.

37. A method as in claim 34, wherein said thin dielectric material has a thickness which is less than the mean free path of the gas intended to be ionized by the ionizing source.

38. A method as in claim 34, wherein said forming electrodes comprises depositing gold, chrome or titanium.

39. A method as in claim 34, wherein said thin dielectric comprises silicon nitride or alumina.

40. A method as in claim 34, wherein said thin dielectric has a thickness less than 500 nm.

41. A method as in claim 34, wherein said thin dielectric has a thickness less than 300 nm.

42. A method as in claim 34, wherein said thin dielectric has a thickness less than 200 nm.

43. A method as in claim 34, wherein said thin dielectric has a thickness of approximately 50 nm.

44. A method as in claim 34, further comprising applying a voltage less than 15 volts between said first and second electrodes to form a field between said first and second electrodes in the range of megavolts per meter.

45. A method as in claim 34, wherein said forming at least one hole in said substrate forms at least one hole tapered inwardly.

46. A system, comprising:

an ionizing device, comprising a support member having at least one opening, a first conductive electrode extending on a first surface of the support member and a second conductive electrode extending on a second surface of the support member, and separator means for separating said first and second conductive electrodes by a width of said separator means, wherein said separator means has a thickness less than the mean free path of the material being ionized.

47. A system as in claim 46, wherein said separator means separates said first and second conductive electrodes by less than 1 micron at said at least one opening.

48. A system as in claim 46, wherein said separator means separates said first and second conductive electrodes by less than 300 nm at said at least one opening.

49. A system as in claim 46, wherein said separator means comprises a dielectric.

50. A system as in claim 46, wherein said separator means is formed of silicon nitride or alumina.

51. A system as in claim 46, wherein said first and second electrodes are formed of one of gold, chrome or titanium.

52. A system as in claim 46, further comprising an element which receives ions from said ionizing device.

53. A system as in claim 46, wherein said separator means separates said first and second conductive electrodes by less than 200 nm at said at least one opening.

54. A system as in claim 46, wherein said separator means separates said first and second conductive electrodes by less than 50 nm at said at least one opening.

55. A system as in claim 46 wherein said at least one opening tapers inwardly from the first surface of the support member to the second surface of the support member.

56. A system as in claim 46 wherein said at least one opening has a diameter approximately in the range of 2–3 microns.

57. An ionizing membrane, comprising:

a thick supporting portion with a first surface and with openings formed in the thick supporting portion;

an insulating clement with first and second surfaces, wherein the insulating element is coated on the first surface of the thick supporting portion and terminates at a first end within the openings to form holes;

a first electrodes coated on die first surface of the insulating element that approximately terminates at the first end of said insulating element;

a second electrode coated on the second surface of the insulating element that approximately terminates at die first end of said insulating element; and wherein a distance between the first and second metal electrodes within the holes is less than the mean free path of a material being ionized.

* * * * *